United States Patent [19]

Hayes

[11] Patent Number: 4,903,897

[45] Date of Patent: Feb. 27, 1990

[54] TURRET NOZZLE WITH BALL VALVE FLOW ADJUSTMENT

[75] Inventor: Jerry R. Hayes, Peoria, Ill.

[73] Assignee: L. R. Nelson Corporation, Peoria, Ill.

[21] Appl. No.: 231,567

[22] Filed: Aug. 12, 1988

[51] Int. Cl.[4] ..... B05B 1/16

[52] U.S. Cl. ..... 239/394; 239/443; 239/525; 239/581.1

[58] Field of Search ..... 239/391, 392, 394, 396, 239/530, 525, 581.1, 289, 561, 562, 436, 443–449; 251/286–288

[56] References Cited

U.S. PATENT DOCUMENTS

| | | | |
|---|---|---|---|
| D. 225,736 | 1/1973 | Mango et al. . | |
| 3,214,133 | 10/1965 | Rodgers et al. | 239/562 |
| 3,319,893 | 5/1967 | Rodgers et al. | 239/396 |
| 3,467,356 | 9/1969 | Mueller | 251/288 |
| 3,776,469 | 12/1973 | Joannon | 239/446 |
| 3,998,390 | 12/1976 | Peterson et al. | 239/394 |
| 4,165,837 | 8/1979 | Rundzaitis | 239/394 |
| 4,347,981 | 9/1982 | Hayes | 239/394 |
| 4,666,085 | 5/1987 | Liaw | 239/394 |

*Primary Examiner*—Robert J. Oberleitner
*Assistant Examiner*—Karen B. Merritt
*Attorney, Agent, or Firm*—Cushman, Darby & Cushman

[57] ABSTRACT

A hose nozzle comprising a tubular body having female threads on one end portion thereof. The tubular body provides a hand grip portion adjacent the one end portion suitable to be grasped in one hand with the thumb naturally extended into an actuating position on an opposite end of the hand grip portion. The tubular body defines an interior water passage and has an inner annular ball valve seat facing toward the passage therein on which a ball valve is mounted for varying the flow rate of the water through the valve seat. A manually actuatable flow directing assembly is provided for receiving water flowing through the valve seat and for directing the same into variable stream formations. An actuating member is provided having a thumb-engaging portion extending in the actuating position for effecting pivotal movements of the actuating member about the pivotal axis of the ball valve by thumb engagement. The mounting of the ball valve and the actuating member is such that (1) the actuating member is retained in any position of pivotal movement into which it is moved by thumb engagement and (2) the ball valve is retained in a corresponding position for determining the variable flow rate of water under pressure through the valve seat.

21 Claims, 4 Drawing Sheets

10
24
42
38
3
14
54
56
2
40
12
124
68
126
60
72
132
134
62
106
64
144
78
58
116
76
16
150
66
152
2
3

TURRET NOZZLE WITH BALL VALVE FLOW ADJUSTMENT

BACKGROUND OF THE INVENTION

This invention relates to water flow nozzles and more particularly to hose nozzles of the manually actuatable type adapted to be connected to an end of a garden hose.

The hose nozzles currently popularly available on the commercial market fall into two general categories; (1) barrel-type hose nozzles and (2) pistol-grip hose nozzles. The typical barrel-type hose nozzle is usually in the form of a generally cylindrical assembly, one end of which is adapted to be connected to the garden hose and the opposite end of which defines the nozzle from which the stream issues. In order to adjust the nature of the stream issuing from the nozzle, it is generally necessary to use two hands in order to turn the forward barrel element with respect to the rearward element. The range of adjustment allows for variation of both the form of the stream issuing from the nozzle orifice as well as the flow rate. However, the two characteristics are linked together and it is not possible to adjust the flow rate independently of the stream formation.

A typical pistol-grip nozzle includes a tubular body having a handle portion connectable at one end to the garden hose and having a fixed barrel portion extending from the opposite end thereof at an angle similar to the angle between the handle and barrel of a pistol. The stream issues from the nozzle at the forward end of the barrel and its shape and flow rate is determined by a valve stem extending through the barrel portion and outwardly through the rear end thereof. The movement of the stem is controlled by a pivoted actuating lever which includes a portion generally parallel with the handle of the nozzle body enabling the user to grip the handle portion and actuating lever and to adjust the stream issuing from the nozzle by a simple squeezing action. Usually, a pivoted bail is provided for holding the actuating lever and adjusting stem in any desired position of adjustment.

A distinct advantage of the pistol-grip type hose nozzle in comparison with the barrel type is the ease with which the stream-varying structure could be moved into and out of its fully closed position from and into any operating position. A disadvantage is that the operator has to hold the actuating lever against a spring action in operating position or operate the bail. In contrast, it is a characteristic of barrel-type nozzles that they are self-maintained in any position of adjustment into which they are moved.

The nature of the typical adjustment provided by the most popular of the pistol-grip nozzles is an adjustment similar to that provided by the typical barrel type nozzle. There have been variations in pistol-grip nozzles which have served to separate the stream formation adjustment from the flow rate adjustment, that is, to provide two controls which would enable these two characteristics to be independently adjusted. The actuating lever of modified pistol-grip nozzles have been used to control the rate of flow from full on to full off and any rate therebetween. Adjustment of the stream formation has been achieved either by providing an assembly similar to the components of a barrel nozzle wherein adjustment is provided by a turning action similar to the turning action of a barrel nozzle or by providing a turret nozzle where adjustment of the stream shape is accomplished by indexing the turret nozzle into a desired one of the plurality of operating positions provided (see, for example, U.S. Pat. No. 4,666,085). In essence, these pistol-grip nozzles provided with dual independent adjustments are simply additive of the advantages and disadvantages of both types of hose nozzles plus the complexity and cost inherent in the addition of the two.

SUMMARY OF THE INVENTION

It is an object of the present invention to provide a hose nozzle having dual independent adjustments which achieves all of the advantages of both types of nozzles but eliminates in good measure the disadvantages thereof. In accordance with the principles of the present invention, this objective is achieved by providing a hose nozzle comprising a tubular body having female threads on one end portion thereof for connecting the same to an end of a hose containing a source of water under pressure. The tubular body extends from the one end portion a distance sufficient to provide a hand grip portion adjacent the one end portion suitable to be grasped in one hand with the thumb naturally extended into an actuating position on an opposite end of the hand grip portion. The tubular body defines an interior water passage extending through the one end portion and hand grip portion thereof for confining water under pressure communicated therewith from a hose containing a source of water under pressure connecting with said hose end connecting threads. An annular ball valve seat is provided in the tubular body facing toward and in water communicating relation with the passage and a ball valve is disposed in the passage in cooperating relation with the ball valve seat for varying the flow rate of water under pressure confined within the passage through the valve seat between zero and maximum. The ball valve is mounted for pivotal movement about an axis transverse to the extent of the hand grip portion between fully opened and fully closed positions with respect to the valve seat corresponding to zero and maximum flow rates respectively. A manually actuatable flow directing assembly is mounted on the tubular body adjacent the opposite end of the hand grip portion for receiving water flowing through the valve seat when the ball valve is out of its fully closed position and for directing the same into the atmosphere in different stream formations determined by the manual actuation thereof. Each of the stream formations extends into the atmosphere in a direction generally parallel with the direction of extent of the hand grip portion of the tubular body such that when the stream formation is directed horizontally the actuating position is disposed in an upper location on the opposite end of the hand grip portion. An actuating member is provided on the exterior of the tubular body adjacent the opposite end of the hand grip portion, the actuating member being mounted in fixed relation with the ball valve for pivotal movements therewith about the pivotal axis of the ball valve. The actuating member has a thumb-engaging lever extending into the actuating position for effecting pivotal movements of the actuating member about the pivotal axis of the ball valve by engagement therewith of the extended thumb of the hand gripping the hand grip portion. The mounting of the ball valve and the actuating member together and with respect to the tubular body and the valve seat is such that (1) the actuating member is retained in any position of pivotal movement into which it is moved by thumb engagement and (2) the ball valve is retained in a corresponding position for determining the variable flow rate of water under pressure through the valve seat.

Preferably, the tubular body is molded of plastic material to include an exterior arcuate wall having an axis coincident with the pivotal axis of the ball valve which is disposed around the actuating member. The arcuate wall includes spaced ends between which the thumb-engaging actuating lever radially extends so as to limit the pivotal movement of the actuating member together with the ball valve to an extent corresponding with (1) the movement of the ball valve between the fully opened and fully closed positions and (2) an angular movement of the actuating lever through an angle of approximately 90°.

Another object of the present invention is the provision of a hose nozzle of the type described which is simple in construction, effective in operation and economical to manufacture.

These and other objects of the present invention will become more apparent during the course of the following detailed description and appended claims.

The invention may best be understood with reference to the accompanying drawings wherein an illustrative embodiment is shown.

DESCRIPTION OF THE PREFERRED EMBODIMENT

Figure 1:
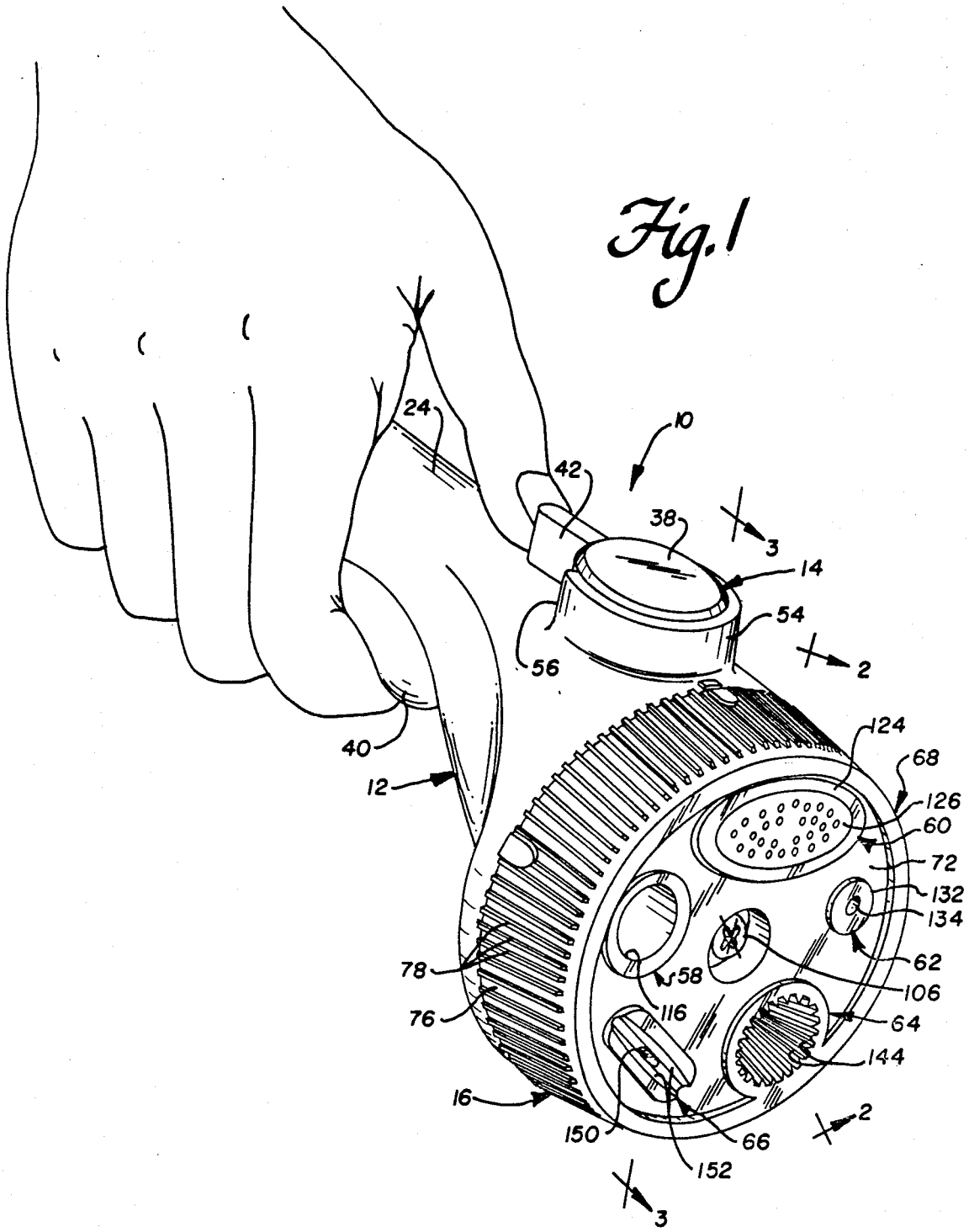
FIG. 1 is a perspective view of a hose nozzle embodying the principles of the present invention, showing the same in relation to the hand of a user when being operated.

Referring now more particularly to the drawings, there is shown in FIG. 1 thereof a hose nozzle, generally indicated at 10, embodying the principles of the present invention. In general, the hose nozzle includes a tubular body, generally indicated at 12, adapted to be connected with a garden hose or the like and having a manually actuatable flow rate varying assembly, generally indicated at 14, for varying the rate of flow of water under pressure to a manually actuated flow directing assembly, generally indicated at 16, which is operable to receive the water under pressure at the flow rate determined by the manually actuated flow rate varying assembly and to direct the water into the atmosphere with different stream formations determined by the manual actuation thereof.

Figure 2:
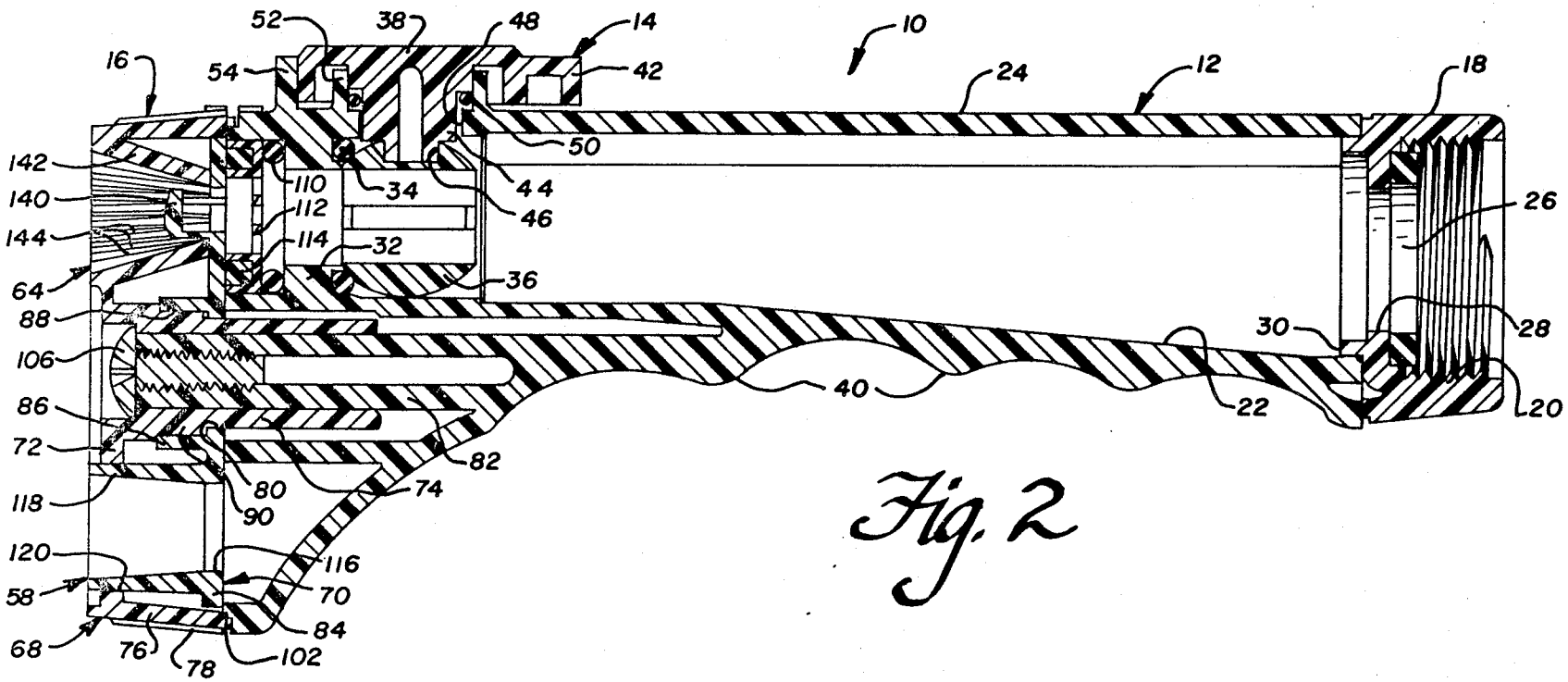
FIG. 2 is a sectional view taken along the line 2–2 of FIG. 1 but with the turret rotated 144° in a counterclockwise direction from the position shown in FIG. 1.

As shown, the tubular body 12 is preferably molded of a suitable thermoplastic material. An example of a suitable material is ABS, such as Cycolac. Other examples include Delrin, Hostyren and the like. In the embodiment shown, the tubular body is of two-piece construction, one piece comprising a separate molding forming an end portion 18 thereof. As best shown in FIG. 2, the end portion 18 is formed with hose end connecting means such as female threads 20 of a size to intermesh with the male threads on a typical hose end fitting. The threads 20 form a part of a water passage 22 which extends through the one end portion 18 and through a hand grip portion 24 of the other piece of the tubular body 10 which extends from the one end portion 18 a distance sufficient to enable the same to be suitably grasped in one hand with the thumb naturally extended into an actuating position on an opposite end of the hand grip portion from the one end portion 18, as is illustrated in FIG. 1.

As best shown in FIG. 2, the water passage leads from the female threads 20 past a conventional hose fitting washer 26 and through the remainder of the one end portion 18 which is defined by a radially inwardly extending flange 28 on which the washer seats and an axially extending flange 30 which provides for an abutting engagement with the adjacent interior marginal edge portion of the passage in the hand grip portion 24 of the tubular body 12. Preferably, the one end portion 18 is sonically welded to the adjacent end of the hand grip portion 24 of the tubular body 12. The water passage 22 extends through the hand grip portion 24 to a radially inwardly extending annular flange 32 formed in the opposite end portion of the tubular body 12. The portion of the flange 32 facing the one end portion is formed with an annular groove within which an O-ring 34 is seated, the O-ring 34 forming an annular ball valve seat which faces toward and is disposed in water-communicating relation with the passage 22 in the hand grip portion 24.

The manually actuatable flow rate varying assembly 14 includes a ball valve 36 which is disposed within the water passage 22 in cooperating relation with the ball valve seat 34 for varying the flow rate of water under pressure confined within the passage 22 through the valve seat 34 between zero and maximum. The ball valve 36 is mounted for pivotal movement about an axis extending transverse to the extent of the hand grip portion 24 between fully opened and fully closed positions with respect to the valve seat 34 corresponding with the zero and maximum flow rates respectively. As shown, the flow rate varying assembly 14 also includes an actuating member 38 which is mounted on the exterior of the tubular body 12 adjacent the end of the hand grip portion 24 opposite from the one end portion 18 in a position adjacent the actuating position into which the user's thumb is naturally extended. In this regard, it will be noted that the exterior surface of the hand grip portion 24 has a surface area in a position opposed to the actuating position molded into a finger grip conforming configuration, as indicated at 40. With this arrangement, it will be noted that the exterior surface of the hand grip portion 22 will accommodate either a righthand grip of a lefthand grip with equal facility so as to accommodate the particular dexterity of any particular user.

As shown, the actuating member 38 as well as the ball valve 36 itself are likewise molded of plastic material. Again, examples are as previously indicated. As shown, the main body portion of the actuating member 38 is of generally cylindrical shape having a thumb-engaging actuating lever 42 extending radially outwardly therefrom. The actuating member 38 also includes an axially extending stem portion 44, a reduced lower end section of which engages within an opening 46 in the exterior periphery of the ball valve 36.

It will be understood that the manner in which the components of the assembly 14 and the tubular body 12 are assembled is to first insert the O-ring 34 forming the valve seat in the groove of flange 32 and then insert the ball valve 36 similarly through the passage with a suitable fixture so as to insure that the opening 46 in the exterior thereof faces in a direction of an opening 48 formed in the upper portion of the wall of the tubular body adjacent the actuating position thereof. The stem portion of the actuating member is then moved through the opening 48 so that the lower end section of the stem portion 44 engages into the opening 46 and the two engaging surfaces thereof are then sonically welded together. It will be noted that prior to the engagement of the stem portion 44 through the opening 48 an O-ring seal 50 is mounted around the periphery of the stem portion in engagement with a shoulder thereof defined by an enlarge cylindrical mounting section thereof in the end section thereof adjacent the end which engages the ball valve opening 46. The tubular body 12 is formed with an upstanding cylindrical wall 52 having a diameter size generally equal to the diameter size of the mounting section of the stem portion 44 so as to pivotally mount both the actuating member 38 and the ball valve 36 for pivotal movement about the pivotal axis of the ball valve. It will be understood that after the assembly described above has been accomplished, end portion 18 is engaged with the end of the hand grip portion 24 and soncially welded thereto.

Figure 5:
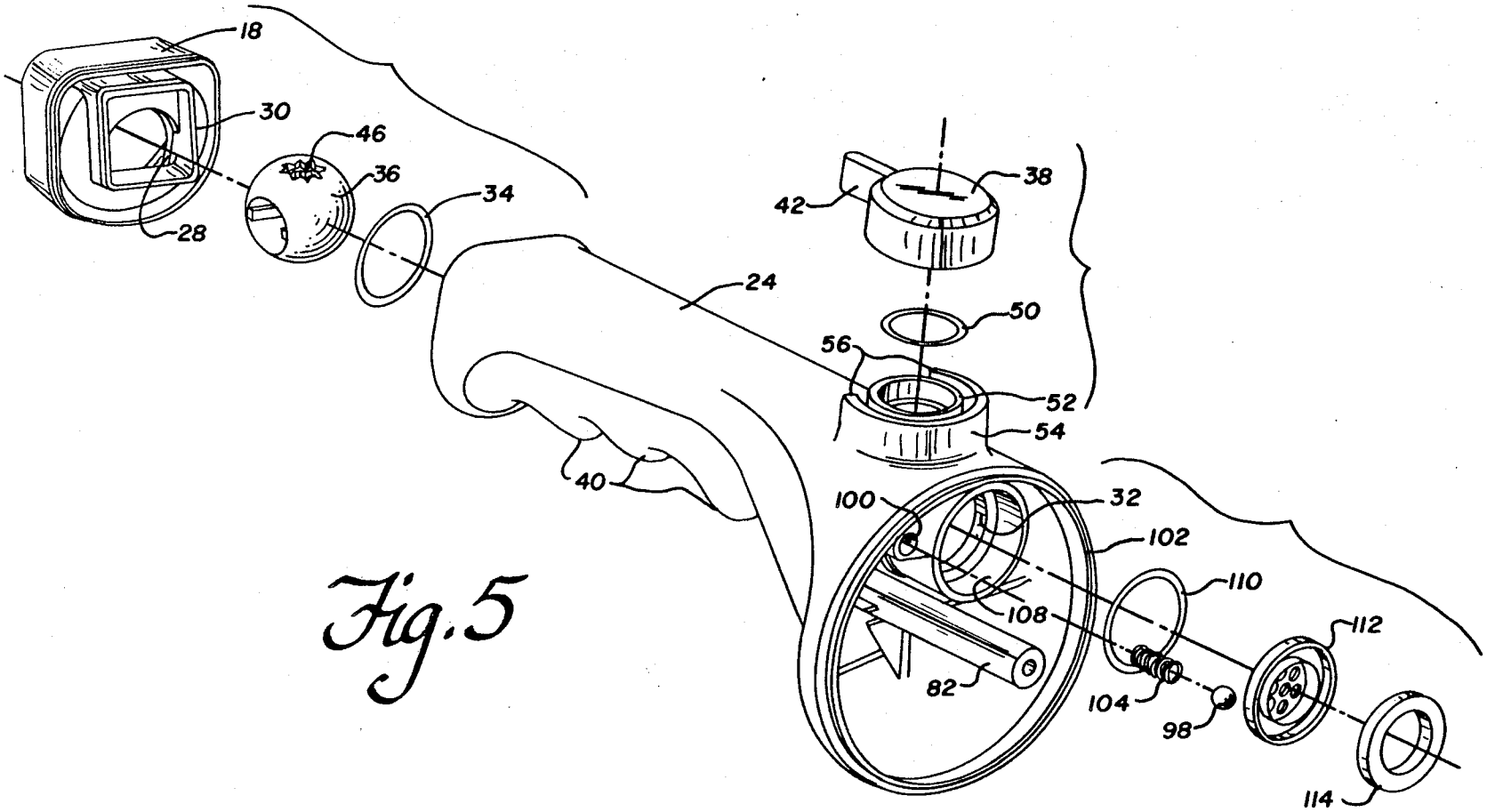
FIG. 5 is an exploded perspective view of the nozzle handle assembly.

Referring now more particularly to FIGS. 1 and 5, the tubular body 12 is molded to include an exterior arcuate wall 54 having an axis coincident with the pivotal axis of the ball valve 56. The arcuate wall 54 extends around the cylindrical body of the actuating member 38 and terminates in spaced ends 56 between which the actuating lever 42 radially extends so as to limit the pivotal movement of the actuating member 38 together with the ball valve 36 to an extent corresponding with (1) the movement of the ball valve 36 between its fully opened and fully closed positions and (2) a pivotal movement of the actuating lever 42 through an angle of approximately 90°.

The manually actuated flow directing assembly 16 is preferably, as shown, in the form of a turret head assembly mounted for rotational indexed movement through five operating positions, the turret assembly 16 providing five different outlets 58, 60, 62, 64, and 66 for forming five different stream formations when the different position of the turret assembly. It will be understood that the manually actuated flow direction assembly 16 could assume forms other than the turret head assembly shown. For example, the assembly could comprise the elements of a conventional barrel nozzle assembly by which a multiplicity of different stream formations (including spray and jet) are achieved by varying the distance between a radially outwardly directing flow stream deflector and a central orifice through which the deflector extends, the orifice having a frustoconical spray surface diverging outwardly therefrom. With the turret assembly shown, a plurality of spray shaped stream formations and a plurality of jet type stream formations can be formed by the outlets provided when they are moved into operative position by the rotational indexed movement of the turret assembly. The turret assembly 16 itself may be of any suitable construction and the number of outlets can be varied from the exemplary five shown. Similarly, the formations which are formed by the outlets can be varied likewise.

Figure 4:
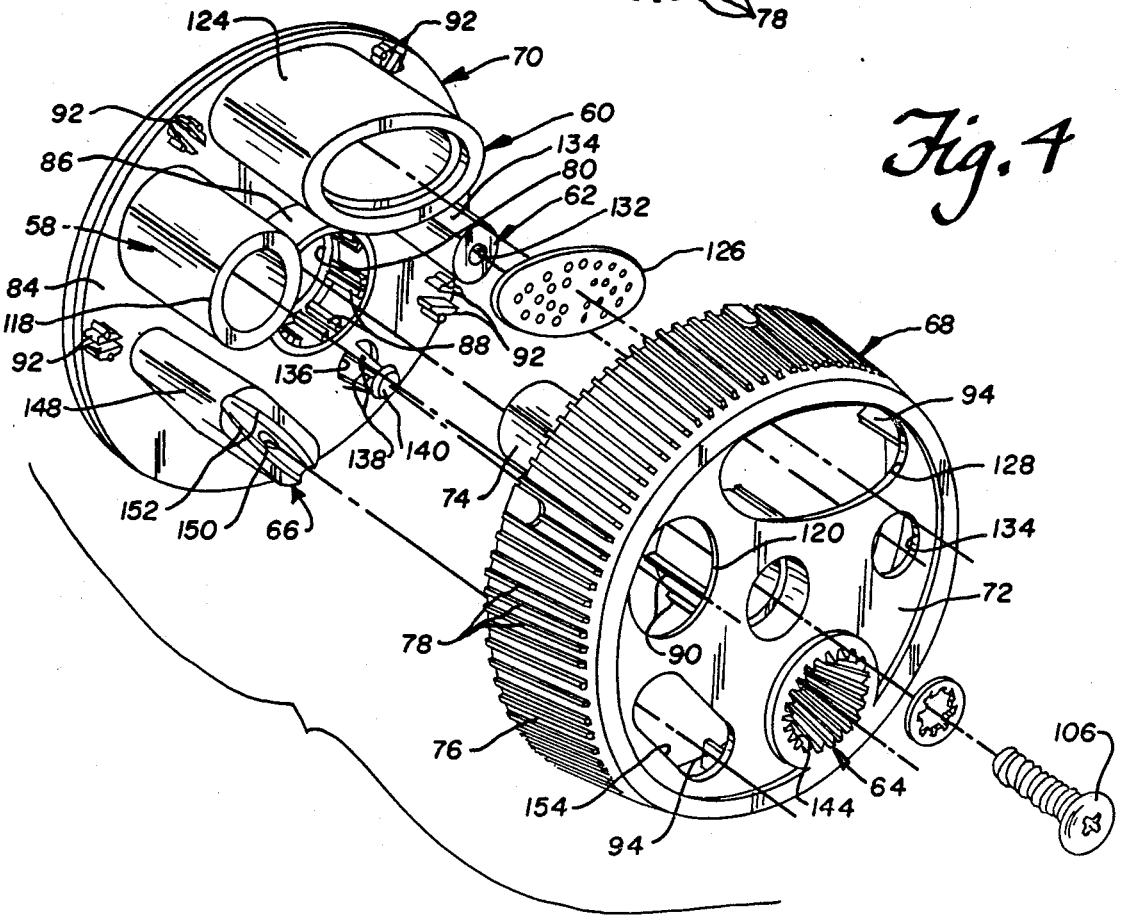
FIG. 4 is an exploded perspective view of the nozzle turret assembly.

In the embodiment shown, the turret assembly 16 is molded of plastic material in separate pieces, the main components of which include an outer part, generally indicated at 68, and a cooperating inner part, generally indicated at 70, which are interengageable to provide the turret head of the assembly 16. As best shown in FIG. 4, the outer part 68 includes a circular wall or face plate 72 having a central tubular mounting portion 74 extending from the central section thereof. Extending around the periphery of the face plate is a peripheral wall 76 which is of generally frustoconical configuration having its exterior peripheral surface suitably roughened. As shown, the surface is formed with a series of parallel ridges 78 or a series of parallel grooves defining ridges so as to provide a gripping surface for assisting the manual rotational indexing of the turret head. The tubular mounting portion 74 of the outer part 68 extends through a central opening 80 in the inner part 70 and is adapted to be rotationally mounted on a hollow shaft 82 forming an integral part with the hand grip portion 24 of the tubular body 12. As best shown in FIG. 2, the hollow shaft 82 provides a rotational axis for the turret head assembly 16 which is generally parallel to the general longitudinal extent of the hand grip portion 24 and spaced in a direction away from the actuating member 38.

The inner part 70 includes a circular base plate 84 which has a central cylindrical wall 86 extending from one side thereof in spaced surrounding relation to the central opening 80. Any suitable means may be provided to insure correct cooperating registry between the parts 68 and 70. As shown, the interior cylindrical surface of the cylindrical wall 86 is formed with slots 88 for engaging splines 90 formed on the exterior periphery of the tubular mounting portion 74 of the outer turret part 68 adjacent the face plate 72. In addition, the base plate 84 includes five spaced pairs of lugs defining slots 92 for receiving ribs 94 extending radially inwardly from the interior periphery of the peripheral wall 76 of the outer turret part 68. It can be seen that when the two turret parts are moved together from the exploded position shown in FIG. 4, the two parts will move together with the splines 90 engaging the slots 88 and the ribs 94 engaging the slots 92 providing by the lugs. Moreover, the periphery of the base plate 84 engages within the marginal inner edge of the peripheral wall of the outer part.

Figure 3:
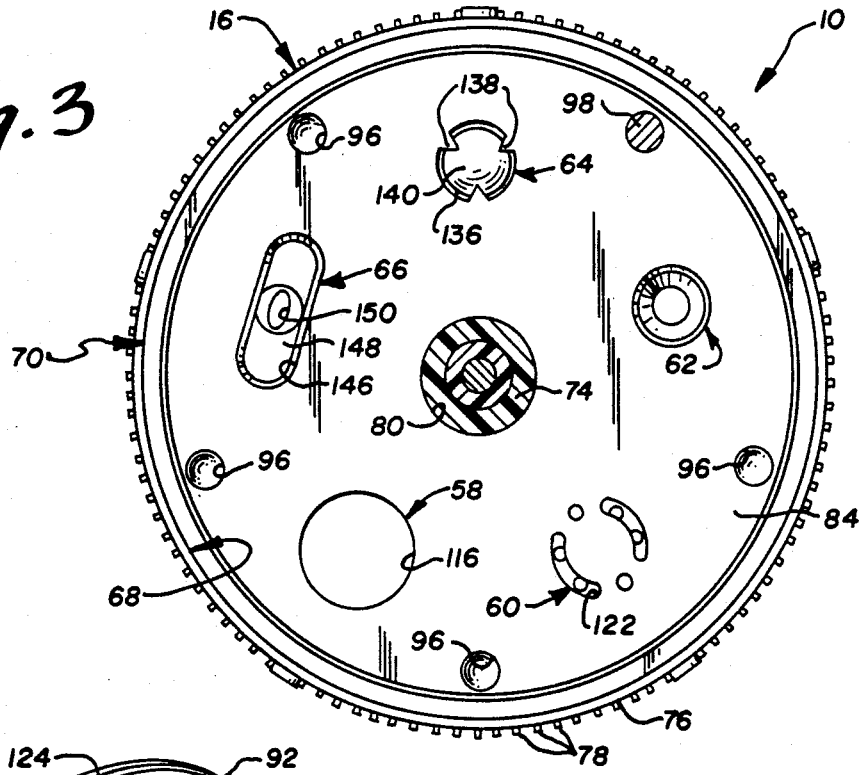
FIG. 3 is a sectional view taken along the line 3—3 of FIG. 1.

As best shown in FIG. 3, the side of the base plate 84 of the inner turret part opposite from the cylindrical wall is formed with five annularly spaced domelike depressions 96. The domelike depressions 96 are of a size to receive an indexing ball 98 which is mounted within the outer end of a bore 100 extending rearwardly into the tubular body 12 at the forward end thereof. As best shown in FIG. 5, the forward end of the tubular body is enlarged and formed into a circular configuration providing a circular ledge 102 for receiving the projecting free edge of the peripheral wall 76 of the outer turret part 68. A spring 104 is mounted in the inner end of the bore 100 and serves to resiliently bias the ball 98 forwardly in a direction outwardly of the bore. The rear surface of the base plate 84 of the turret part 70 is retained against the ball 98 by bolt 106 which is threaded into the interior of the hollow shaft 82 so that its head engages the central exterior of the face plate 72 of the outer turret part 68.

As is best shown in FIG. 5, the forward end of the tubular body 12 is formed with a counterbore 108 which communicates with the interior periphery of the angular flange 80. Mounted within the counterbore 108 is a resilient O-ring seal 110. Mounted against the O-ring seal 110 is a annular seal-retaining element 112 having a perforated central portion allowing the flow of water therethrough and an outwardly grooved peripheral portion within which is mounted a resilient washer seal 114. The washer seal 114 protrudes from the annular groove of the element 112 and engages with the rear surface of the base plate 84 of the inner turret part 70.

Again referring to FIG. 3, it will be noted that as the turret head is rotated the ball 98 will be resiliently urged forwardly so as to enter a dome-shaped depression 96 when the same is aligned with the bore. This constitutes an indexed rotational operative position of the turret head and it will be noted that each of the five outlets are disposed in a position to receive the water passing through the center of the element 112 within the washer seal 114 when in its corresponding operative position.

As shown, outlet 58 is an outlet configured to provide a maximum flow stream formation directed from the turret assembly 16. To this end, the outlet constitutes a relatively large opening 116 formed in the base plate 84, the opening 116 extending forwardly therefrom through an annular wall 118, the forward end of which seats within an opening 120 in the face plate 72 when the two turret parts are together forming the turret head.

The outlet 60 is configured to direct the water outwardly into the atmosphere in a gentle spray formation. As best shown in FIGS. 3 and 4, the outlet 60 includes a series of openings 122 arranged annularly in the base plate 84 of the turret head part 70. A oval-shaped annular wall 124 extends from the opposite side of the base plate 84 in surrounding relation to the openings 122 and an oval-shaped slightly domed multiply apertured plate 126 is disposed in the end of the oval wall 124. The oval plate 126 is suitably fixed therein as by sonic welding or the like. The face plate 72 is formed with an oval opening 128 to receive the forward end of the annular wall and apertured plate therethrough.

The outlet 62 is configured to discharge the water in a power jet formation. To this end, a cylindrical projection 130 is formed on the forward side of the base plate 84 and a venturi shaped opening 132 extends through the base plate 84 and the cylindrical projection 130. The face plate 72 is formed with a small circular opening 134 to receive the forward end of the cylindrical projection 130.

The outlet 64 is configured to direct the water in an annular outwardly diverging spray pattern. To this end, the base plate 84 of the turret part 70 is formed with a circular opening 136 within which there are formed integral annularly spaced legs 138 which extend forwardly and terminate in an integral stream deflector 140 for directing the water passing through the opening 136 in a radially outward direction. The face plate 72 is formed with a rearwardly extending frustoconical projection 142 the inner surface of which is formed with a series of stream-defining grooves 144. The water flows through opening 136 and is deflected radially outwardly by the deflector 140 into the grooves 144 where the water is defined into a series of streams directed into the atmosphere in a diverging direction.

The outlet 66 is configured to direct the water into the atmosphere in a fan shaped spray. To this end, the base plate 84 is formed with an elongated opening 146. Formed integrally on the forward side of the base plate 84 is an annular wall 148 of similar configuration which terminates in a free end portion having a central orifice 150 extending therethrough and generally fan shaped surfaces 152 extending from the outer end of the orifice 152. The face plate 72 is formed with an elongated opening 154 for receiving the forward of the wall therethrough.

It can be seen that the hose nozzle 10 of the present invention thus provides for independent simple and convenient adjustment of the flow rate and the stream formation. It is provided by a relatively simple construction almost all the components of which are molded plastic material.

The utilization of a ball valve 36 is particularly desirable in that it is a relatively inexpensive piece to provide and its inherent nature is such that it is biased by the water which it controls into frictional sealing engagement with the O-ring 34 forming the valve seat. This frictional contact together with the remaining frictional contact provided by the mounting of the ball valve 36 and actuating member 38 within the tubular body 12 provides the ball valve with the inherent capability of being self-maintained into any position in which it is easily manually moved. Moreover, the configuration of the hand grip portion and the location of the actuating lever 42 with respect thereto provides a convenience and simplicity to the operation of the hose nozzle by the user.

It thus will be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A hose nozzle comprising a tubular body having means on one end portion thereof for connecting the same to an end of a hose containing a source of water under pressure, said tubular body extending from said one portion a distance sufficient to provide a hand grip portion adjacent said one end portion suitable to be grasped in one hand with the thumb naturally extended into an actuating position on an opposite end of the hand grip portion, said tubular body defining an interior water passage extending through the one end portion and hand grip portion thereof for confining water under pressure communicated therewith from a hose containing a source of water under pressure connecting with said hose end connecting means, an annular ball valve seat in said tubular body facing toward and in water communicating relation with said passage, a ball valve disposed in said passage in cooperating relation with said ball valve seat for varying the flow rate of water under pressure confined within said passage through said valve seat between zero and maximum, said ball valve being mounted for pivotal movement about an axis transverse to the extent of said hand grip portion between fully opened and fully closed positions with respect to said valve seat corresponding to zero and maximum flow rate respectively, a manually actuatable flow direction assembly mounted on said tubular body adjacent the opposite end of said hand grip portion for receiving water flowing through said valve seat when said ball valve is out of its fully closed position and for directing the same into the atmosphere in different stream formations determined by the manual actuation thereof, each of which extends into the atmosphere in a direction generally parallel with the direction of extent of the hand grip portion of said tubular body such that when the stream formation is directed horizontally the actuation position is disposed in an upper location on said opposite end of said hand grip portion, and an actuating member disposed on the exterior of said tubular body adjacent the opposite end of said hand grip portion, said actuating member being mounted in fixed relation with said ball valve for pivotal movements therewith about the pivotal axis of said ball valve, said actuating member having thumb-engaging means thereon disposed in said actuating position for effecting pivotal movements of said actuating member about the pivotal axis of said ball valve by engagement therewith of the extended thumb of the hand gripping said hand grip portion, the mounting of said ball valve and said actuating member together and with respect to said tubular body and valve seat being such that (1) the actuating member is retained in any position of pivotal movement into which it is moved by thumb engagement and (2) the ball valve is retained in a corresponding position for determining the variable flow rate of water under pressure through said valve seat.

2. A hose nozzle as defined in claim 1 wherein said thumb-engaging means comprises an actuating lever and means for limiting the pivotal movement of said actuating member together with said ball valve to an extent corresponding with (1) the movement of the ball valve between said fully opened and fully closed positions and (2) a pivotal movement of said actuating lever through an angle of approximately 90°.

3. A hose nozzle as defined in claim 2 wherein said tubular body is molded of plastic material to include an exterior arcuate wall having an axis coincident with the pivotal axis of said ball valve and being disposed around said actuating member, said arcuate wall having spaced ends between which said actuating lever radially extends.

4. A hose nozzle as defined in claim 3 wherein said actuating member is molded of plastic material to include a body portion of generally cylindrical shape having an exterior periphery closely adjacent the interior periphery of said arcuate wall and an axial extent generally equal to the axial extent of said arcuate wall.

5. A hose nozzle as defined in claim 4 wherein said actuating member further includes a stem portion extending from said body portion, said stem portion being fixed to said ball valve, and an O-ring seal forming a watertight seal between said stem portion and said tubular body for preventing water under pressure contained in said passage from leaking passed said stem portion.

6. A hose nozzle as defined in claim 5 wherein said ball valve is molded of plastic material and is sonically welded to said stem portion.

7. A hose nozzle as defined in claim 6 wherein said hose end connecting means includes female threads formed in said one end portion.

8. A hose nozzle as defined in claim 7 wherein said one end portion and said hand grip portion are separately molded of plastic material and sonically welded together.

9. A hose nozzle as defined in claim 8 wherein an exterior surface area of said hand grip portion in a position opposed to the actuating position thereon is molded into a finger grip conforming configuration.

10. A hose nozzle as defined in claim 9 wherein said valve seat is provided by an O-ring seal mounted in an annular groove formed in said tubular body.

11. A hose nozzle as defined in claim 10 wherein said manually actuatable flow directing assembly comprises a turret assembly mounted for rotational indexed movement through a plurality of operative positions, said turret assembly having a number of different outlets for forming a number of different stream formations corresponding to the number of different operative positions of said turret assembly.

12. A hose nozzle as defined in claim 11 wherein the rotational axis of said turret assembly is generally parallel with the extent of the hand grip portion of said tubular body.

13. A hose nozzle as defined in claim 11 wherein one of said outlets includes a plurality of spaced small openings for forming a gentle spray formed of a corresponding plurality of parallel streams.

14. A hose nozzle as defined in claim 11 wherein one of said outlets is a single venturishaped orifice for forming a jet stream.

15. A hose nozzle as defined in claim 11 wherein one of said outlets includes a series of annularly spaced radially inwardly open grooves extending in outwardly diverging relation and a central flow-directing member for directing the flow of water in a generally radially outward direction onto said grooves for flow therein outward so as to form an annular spray.

16. A hose nozzle as defined in claim 11 wherein one of said outlets is an orifice having a fan-shaped exit for forming a fan-shaped spray.

17. A hose nozzle as defined in claim 11 wherein one of said outlets is a large opening for forming a maximum flow stream.

18. A hose nozzle as defined in claim 2 wherein an exterior surface area of said hand grip portion in a position opposed to the actuating position thereon is molded into a finger grip conforming configuration.

19. A hose nozzle as defined in claim 1 wherein said one end portion and said hand grip portion are separately molded of plastic material and sonically welded together.

20. A hose nozzle as defined in claim 1 wherein said valve seat is provided by an O-ring seal mounted in an annular groove formed in said tubular body.

21. A hose nozzle as defined in claim 1 wherein said manually actuatable flow directing assembly comprises a turret assembly mounted for rotational indexed movement through a plurality of operative positions, said turret assembly having a number of different outlets for forming a number of different stream formations corresponding to the number of different operative positions of said turret assembly.

* * * * *